US009694295B2

(12) United States Patent
Walterscheid

(10) Patent No.: US 9,694,295 B2
(45) Date of Patent: Jul. 4, 2017

(54) SUCTION CUP CHARACTER AND CAPSULE ASSEMBLY

(75) Inventor: Steve Walterscheid, Banks, OR (US)

(73) Assignee: KMA Concepts Limited, Tsim Sha Tsui, Kowloon (HK)

( * ) Notice: Subject to any disclaimer, the term of this patent is extended or adjusted under 35 U.S.C. 154(b) by 1791 days.

(21) Appl. No.: 12/982,761

(22) Filed: Dec. 30, 2010

(65) Prior Publication Data

US 2012/0108138 A1 May 3, 2012

Related U.S. Application Data

(60) Provisional application No. 61/407,900, filed on Oct. 28, 2010.

(51) Int. Cl.

| | |
|---|---|
| ***A63H 3/00*** | (2006.01) |
| ***A63H 33/00*** | (2006.01) |
| ***A63H 3/50*** | (2006.01) |
| *A63H 33/06* | (2006.01) |

(52) U.S. Cl.

CPC ..... *A63H 3/50* (2013.01); *A63H 3/003* (2013.01); *A63H 33/00* (2013.01); *A63H 33/06* (2013.01)

(58) Field of Classification Search

CPC . A63H 3/003; A63H 3/36; A63H 3/50; A63H 33/00; A63H 33/06; A63H 33/103

USPC ..... 446/72, 73, 75–77, 85, 100, 177

See application file for complete search history.

(56) References Cited

U.S. PATENT DOCUMENTS 1,710,989 A 4/1929 Kelly
2,219,130 A * 10/1940 Herrmann ..... A63H 3/04 273/DIG. 25
2,469,589 A * 5/1949 Barricini ..... A23G 3/563 426/104
2,858,955 A 11/1958 Kroenert
2,975,930 A * 3/1961 Pennington ..... B63B 35/34 220/23.4
3,127,985 A * 4/1964 Scott ..... A46B 17/04 132/308
3,158,954 A * 12/1964 Green ..... A63H 33/04 446/92
4,103,774 A * 8/1978 Shingyouchi ..... A45C 1/12 206/216

(Continued)

FOREIGN PATENT DOCUMENTS

ES GB 2277511 A * 11/1994 ..... A23G 3/50
GB 2277511 A * 11/1994

*Primary Examiner* — Gene Kim

*Assistant Examiner* — Alyssa Hylinski

(74) *Attorney, Agent, or Firm* — LaMorte & Associates, P.C.

(57) ABSTRACT

An assembly of a toy and a capsule. The toy can be selectively removed from the capsule. Alternatively, the toys can be left inside the capsule and multiple capsules can be interconnected to produce a larger toy structure. Each capsule used in the system has a first half and a second half. The two halves selectively interconnect along a common seam. When the capsule is closed, the capsule's interior can only be accessed through an access opening. Each capsule comes with a toy figure that is held within its interior. The toy figure is mounted to a suction cup. The suction cup remains external of the capsule while the toy figure is inside the capsule. A neck links the toy figure to the suction cup through the access opening in the capsule. Different capsules can be interconnected to build a larger structure.

16 Claims, 5 Drawing Sheets

(56) References Cited

U.S. PATENT DOCUMENTS

| | | | | | |
|---|---|---|---|---|---|
| 4,106,657 | A * | 8/1978 | Dogliotti | A23G 1/545 | 206/504 |
| 4,964,831 | A * | 10/1990 | Wolff | A63H 33/00 | 428/542.4 |
| 5,655,303 | A * | 8/1997 | Janczak | A47G 21/02 | 30/324 |
| 5,773,058 | A * | 6/1998 | Jones | B65D 43/0212 | 426/106 |
| 5,874,119 | A * | 2/1999 | Coleman | A23G 3/563 | 426/104 |
| 6,050,438 | A | 4/2000 | Kovens et al. | | |
| 6,176,705 | B1 * | 1/2001 | Garvey | A63H 3/00 | 434/284 |
| 6,264,524 | B1 * | 7/2001 | Crane | A63H 3/50 | 40/597 |
| 6,966,813 | B2 * | 11/2005 | Donahue | A63H 33/067 | 403/217 |

* cited by examiner

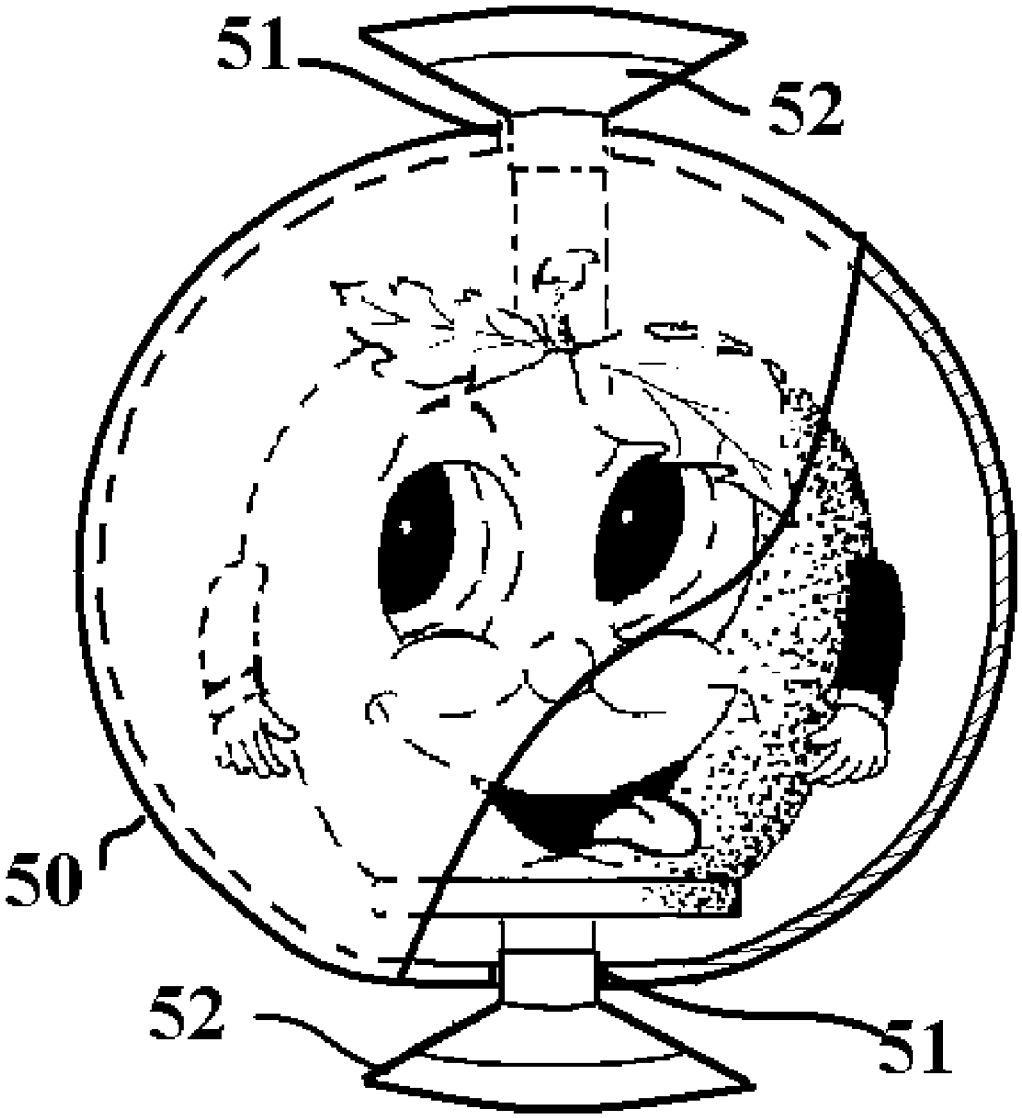
*FIG.* 5

SUCTION CUP CHARACTER AND CAPSULE ASSEMBLY

RELATED APPLICATIONS

This application is a continuation-in-part of co-pending provisional patent application No. 61/407,900, entitled Suction Cup Character And Capsule, filed Oct. 28, 2010.

BACKGROUND OF THE INVENTION

1. Field of the Invention

In general, the present invention relates to toy characters that have suction cups at their base. The present invention also relates to toy characters that are packaged in hard plastic capsules, such as those used in bulk vending machines.

2. Prior Art Description

Toy characters that have suction cup bases have been sold commercially for much of the past century. The use of a suction cup at the bottom of the character enables the character to be anchored to any smooth surface. Accordingly, toy character with suction cup bases are commonly sold as bathtub toys or window decorations. An early toy characters with a suction cup base is exemplified by U.S. Pat. No. 1,710,989 to Kelly, entitled Clinging Figure. A modern example of a toy character with a suction cup base is shown in U.S. Pat. No. 6,264,524 to Crane, entitled Toy Figure With Removable Suction Cup.

Likewise, bulk vending machines that dispense toys in capsules have also been existence for nearly a century. In this long period of time, capsules have been made in a variety of shapes and sizes. Traditionally, such capsules had an acorn shape, such as is exemplified in U.S. Pat. No. 2,858,955 to Kroenert, entitled Merchandise Capsules. However, in more recent times, round capsules have become more popular, such as those exemplified in U.S. Pat. No. 6,050,438 to Kovens, entitled Spherical Dispensing Capsule.

Throughout the long history of both suction cup toys and capsules for holding toys, there have certainly been situations where a suction cup toy has been packaged within a toy capsule. However, if such a pairing has happened, the suction cup toy was certainly packaged completely within the capsule; having no part of the toy extending from the capsule. This is due to prior art capsules for toys having solid surfaces that were used to envelop and protect the inner packaged toy.

The applicant has developed a new capsule design that works in conjunction with a suction cup toy to produce an integrated assembly that has play value beyond that of just the suction cup toy or the capsule. This new design is described and claimed below.

SUMMARY OF THE INVENTION

The present invention is an assembly of a toy and a capsule. The toy can be selectively removed from the capsule. Alternatively, the toys can be left inside the capsule and multiple capsules can be interconnected to produce a larger toy structure.

Each capsule used in the system has a first half and a second half. The two halves selectively interconnect along a common seam with a snap-fit connection. Each capsule defines an open interior.

When the capsule is closed, the open interior can only be accessed through at least one access opening that is formed along the common seam of the capsule.

Each capsule comes with a toy figure that is positioned within the interior of the capsule. The toy figure is mounted to a suction cup. However, the suction cup remains external of the capsule while the toy figure is inside the capsule. A neck links the toy figure to the suction cup through an access opening in the capsule.

Different capsules can be interconnected in two different ways. In the first way, the suction cups that extend outside the capsules can be used to attach different capsules together. In the second way, the capsules can be opened and the halves of two different capsules can be interconnected to produce a hybrid capsule. Both connection techniques enable multiple capsules to be joined and built into a larger structure.

BRIEF DESCRIPTION OF THE DRAWINGS

For a better understanding of the present invention, reference is made to the following description of an exemplary embodiment thereof, considered in conjunction with the accompanying drawings, in which:

FIG. 5 is an exploded view of an alternate exemplary embodiment of the present invention.

DETAILED DESCRIPTION OF THE DRAWINGS

Figure 1:
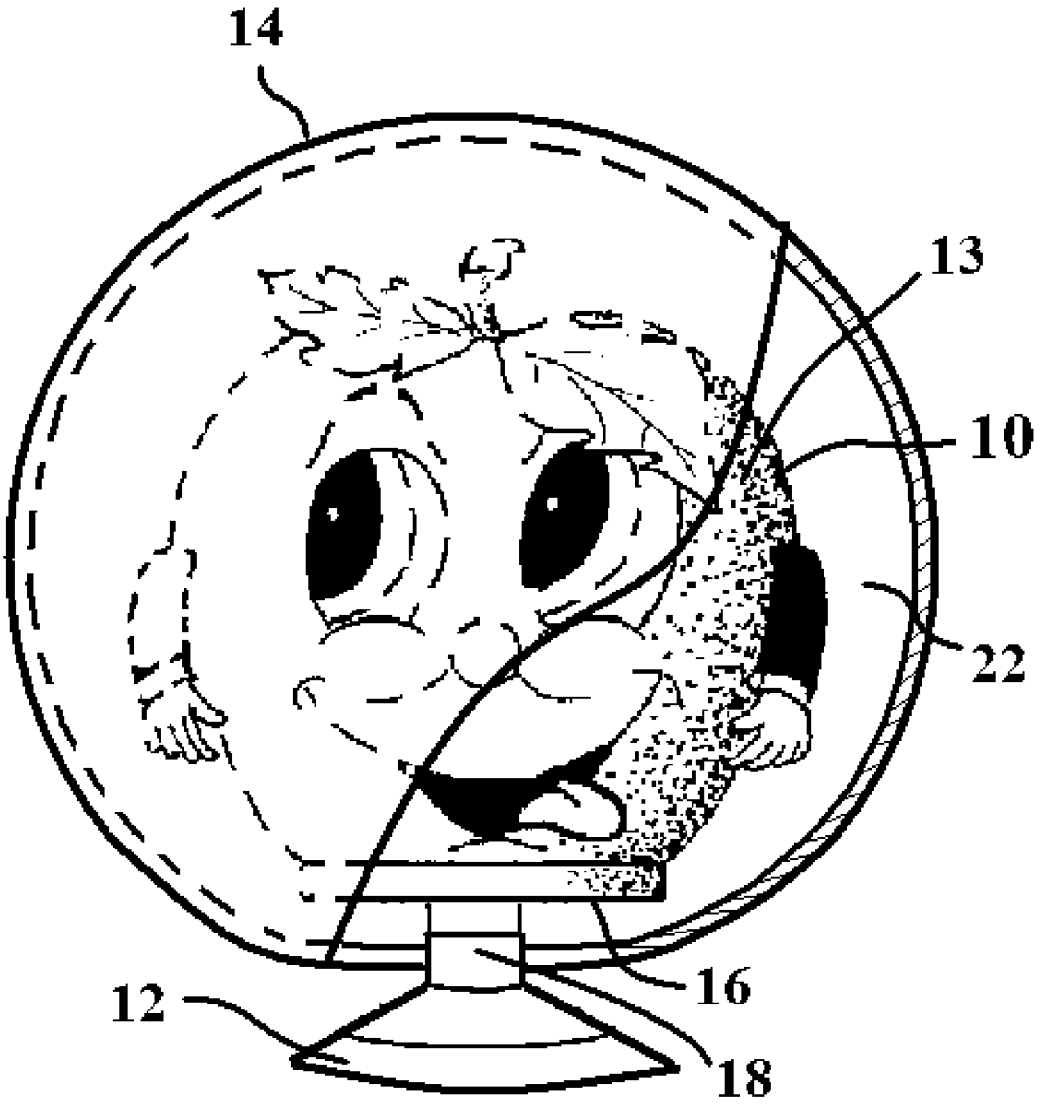
FIG. 1 is a perspective view of an exemplary embodiment of a toy assembly.
Figure 2:
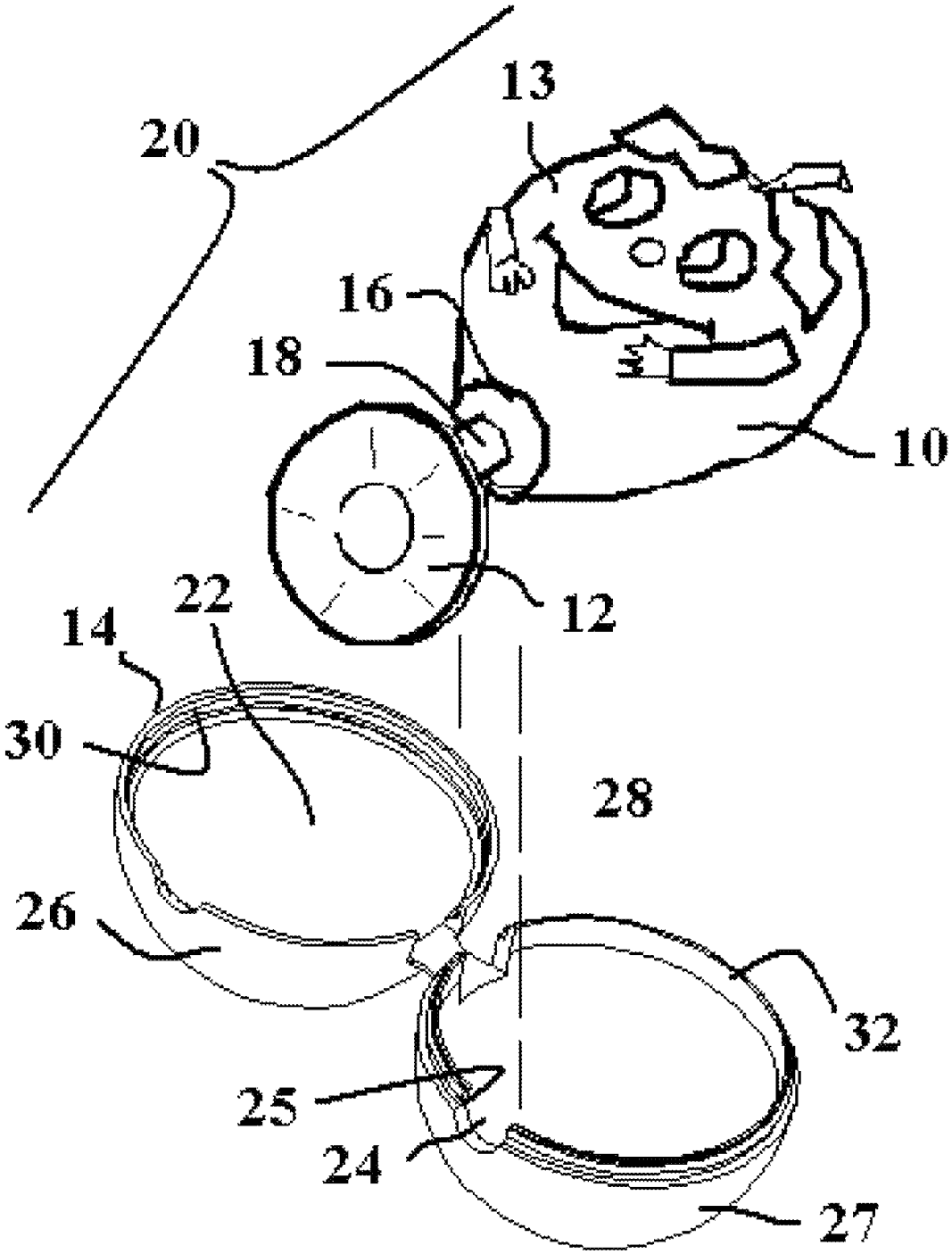
FIG. 2 is an exploded view of the exemplary embodiment of FIG. 1.
Figure 3:
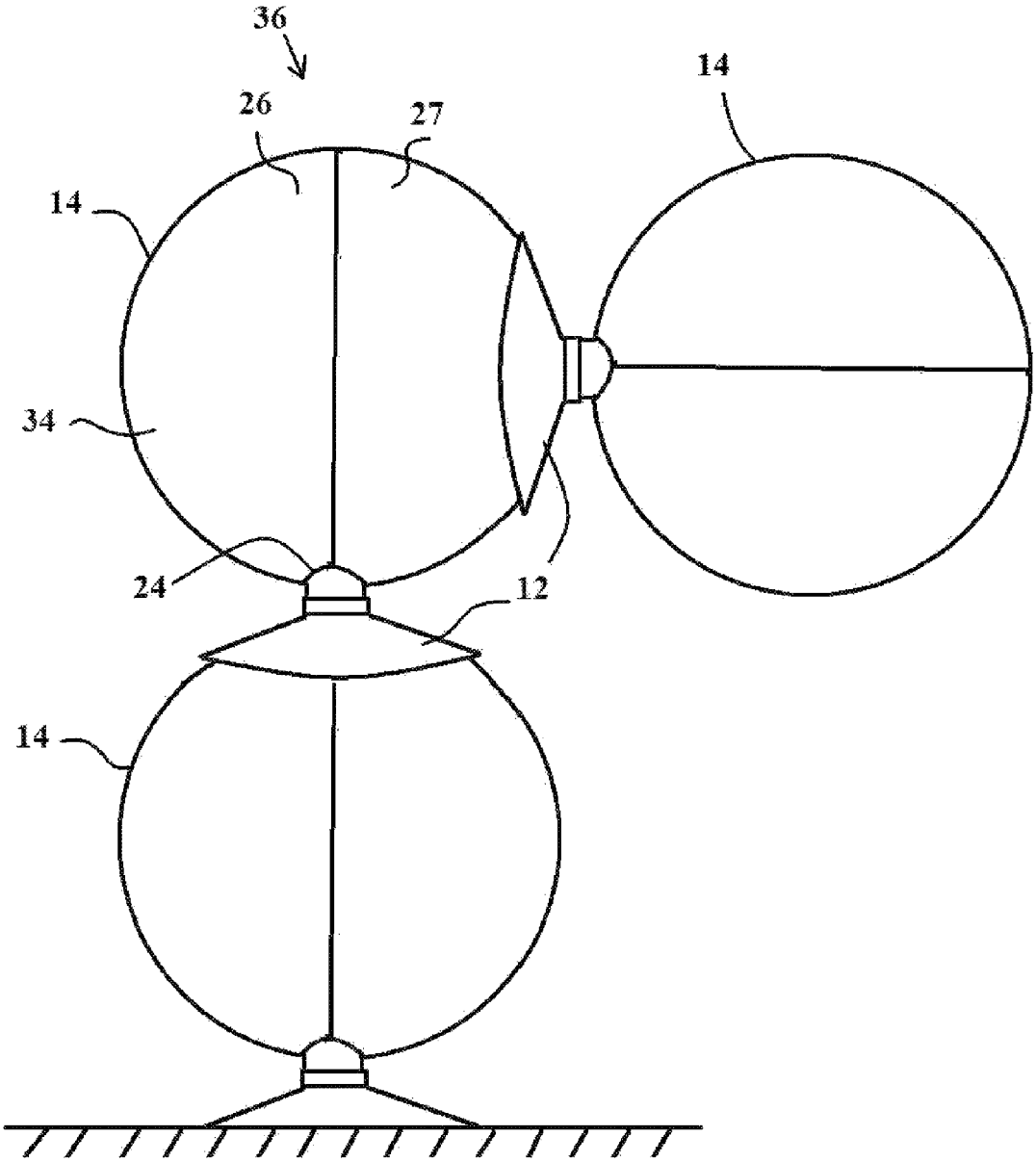
FIG. 3 is a front view of a toy structure made from interconnecting a plurality of toy assemblies using a first method of interconnection.

Referring to FIG. 1 in conjunction with both FIG. 2 and FIG. 3, it will be understood that the present invention is a toy FIG. 10 having a suction cup 12 as a base. The toy FIG. 10 is a molded product that is preferably made from a soft or elastomeric material 13. However, hard plastics can also be used. The toy FIG. 10 can have any form, such as a humanoid form, animal form or any object form, such as a car. The only limitation to the toy FIG. 10 is that the toy FIG. 10 occupy a volume of space small enough to fit inside the confines of a capsule 14.

The toy FIG. 10 has a bottom surface 16. The suction cup 12 is positioned below the bottom surface 16 of the toy FIG. 10. The suction cup 12 is connected to the toy FIG. 10 by the neck 18. The neck 18 preferably has a circular cross-section and a maximum diameter D1. The maximum diameter D1 of the neck 18, however, is smaller than the width of either the suction cup 12 or the toy FIG. 10.

The suction cup 12 is oriented in the same plane as is the bottom surface 16 of the toy FIG. 10. In this manner, when the suction cup 12 is attached to a flat surface, the suction cup 12 supports the toy FIG. 10 in an upright position.

The toy FIG. 10 and the suction cup 12 combine to create a toy assembly 20. Although the exemplary embodiment being illustrated shows the suction cup 12 and the toy FIG. 10 as separate elements of the same toy assembly 20, it will be understood that the suction cup 12, the neck 18 and the toy FIG. 10 can be integrally molded together as a unistructural unit.

The toy assembly 20 is packaged in a capsule 14. The capsule 14 can be opaque. However, it is preferred that the capsule 14 be translucent so that the toy FIG. 10 can be viewed while inside the capsule 14. The capsule 14 defines on open interior 22. An access opening 24 is formed through the capsule 14. The access opening 24 has the same shape as the cross-sectional shape of the neck 18. Furthermore, the diameter of the access opening 24 is the same or even slightly smaller than the diameter D1 of the neck 18. In this manner, when the neck 18 under the toy FIG. 10 extends through the access opening 24, there is a friction fit between the exterior of the neck 18 and the interior edge 25 of the access opening 24.

When the toy assembly 20 is packaged in the capsule 14, the suction cup 12 of the toy assembly 10 remains external of the capsule 14 and the neck 18 of the toy assembly 20 extends through the access opening 24. The toy FIG. 10 is positioned within the interior 22 of the capsule 14. The frictional fit between the access opening 24 and the neck 18 of the toy FIG. 10 prevents inadvertent movement of the toy assembly 20 relative the capsule 14.

The capsule 14 can be made of separate parts or have a clamshell design with parts that are joined by a hinge. The latter is used in the exemplary embodiment. In the exemplary embodiment, each capsule 14 has two halves 26, 27 that are interconnected by a hinge 28. The first half 26 of the capsule 14 has a connecting edge 30 that is capable of interconnecting with the connecting edge 32 of the opposite capsule half 27 with a snap-fit connection along a common seam 33. In the exemplary embodiment, the capsule 14 is spherical in shape. However, it should be understood that other capsule shapes, such as square shapes and oblong shapes can also be used.

The capsule 14 is selectively configurable between an open condition and a closed condition. When the capsule 14 is in its closed configuration, the two halves 26, 27 join along their connecting edges 30, 32. The only access into or out of the interior 22 of the capsule 14 is therefore through the access opening 24. In its open condition, the two halves 26, 27 of the capsule 14 separate and spread apart at the hinge 28. The toy assembly 20 can then be freely placed into, or removed from the capsule 14.

Each half 26, 27 of the capsule 14 has an exterior surface 34 that is smooth. In this way, the suction cup 12 from one toy assembly 20 that extends from a first capsule 14 can attach to the exterior surface 34 of another capsule 14. This joins a plurality of toy assemblies 20 and capsules 14 together into a three-dimensional structure 36 (FIG. 3). The more toy assemblies 20 and capsules 14 an individual buys, the larger the three-dimensional structure 36 can be built.

Figure 4:
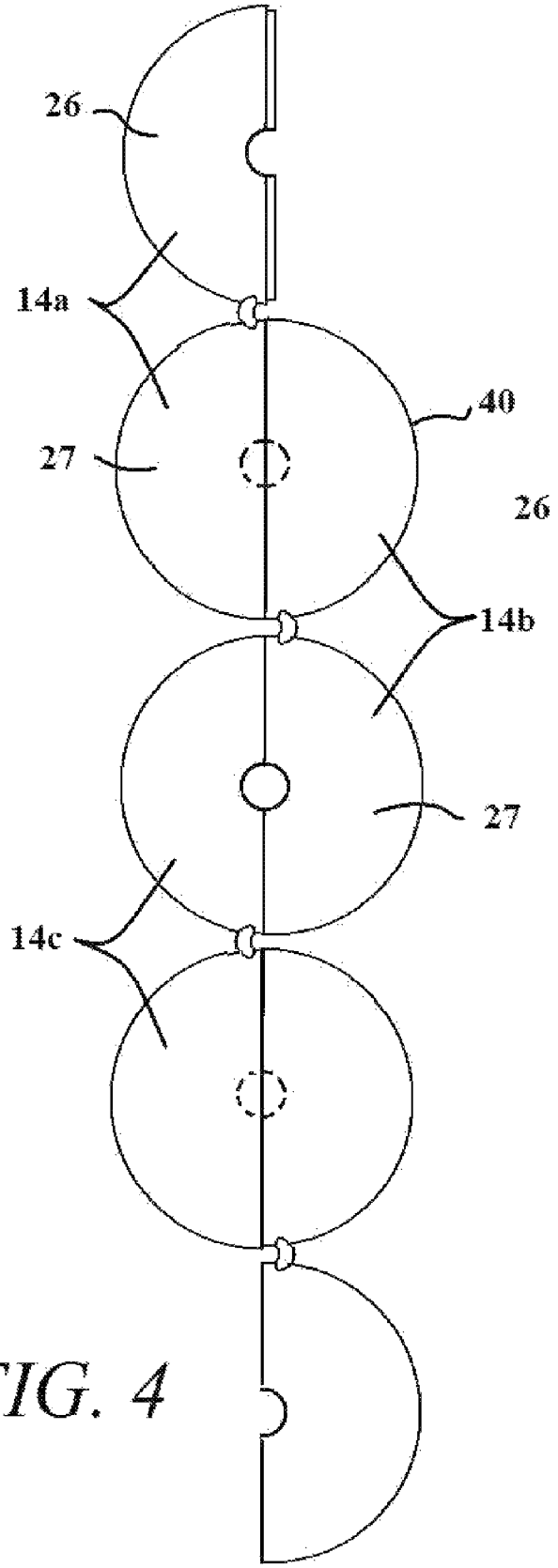
FIG. 4 is a front view of a toy structure made from interconnecting a plurality of toy assemblies using a second method of interconnection.

Referring to FIG. 4 in conjunction with FIG. 2, another technique of interconnecting a plurality of capsules 14*a*, 14*b*, 14*c* is shown. In this embodiment, each capsule 14*a*, 14*b*, 14*c* is configured into its open condition. As such, the connecting edges 30, 32 of each half 26, 27 of each capsule 14*a*, 14*b*, 14*c* are exposed. Each open half 26, 27 of each capsule 14*a*, 14*b*, 14*c* is then interconnected with the open halves 26, 27 of a different capsule. As a result, the two halves 26, 27 from two different open capsules combine to create a closed hybrid capsule 40. The hybrid capsules 40 are mechanically interconnected by the hinges 28 that join together the halves 26, 27 of the original capsules 14*a*, 14*b*, 14*c*.

Referring to FIG. 3 and FIG. 4 together, it will be understood that a plurality of capsules can be mechanically interconnected into a three-dimensional structure 36. Furthermore, in the three-dimensional structure 36, each capsule 14 or hybrid capsule 40 can still retain a toy assembly 20. Furthermore, the interconnection technique shown in FIG. 3 can be combined with the connection technique shown in FIG. 4 to create assemblages with capsules that are interconnected by the suction cups of toy assemblies and by the hinges between capsule halves.

Referring to FIG. 5, an alternate embodiment of a toy assembly and capsule is shown. In this embodiment, the capsule 50 has a plurality of access openings 51. Likewise, the toy assembly 53 has a plurality of extending suction cups 52. In this manner, more than one suction cup 52 extends from the capsule 50. In this manner, the assembly has multiple points where it can attach to another capsule. It will be understood that the number of access openings 51 in the capsule 50 can surpass the number of suction cups 52 extending from the toy assembly 53.

It will be understood that the embodiment of the present invention that is illustrated and described is merely exemplary and that a person skilled in the art can make many variations to that embodiments. For instance, the capsules can be made in shapes other than circular. Furthermore, capsules can be made to hold more than one toy assembly and will therefore have more than one suction cup extending from the capsule. All such embodiments are intended to be included within the scope of the present invention as defined by the claims.

What is claimed is:

1. An assembly comprising:

a capsule having a first half and a second half that selectively interconnect, wherein said capsule defines an interior and an access opening that extends through said capsule for providing access to said interior;

a toy figure positioned within said interior of said capsule;

a suction cup external of said capsule; and a neck that interconnects said toy figure with said suction cup, said neck extending through access opening, wherein the access opening engages said neck with a friction fit, therein positioning said toy figure within said interior of said capsule without said toy figure contacting said capsule and preventing said toy figure from inadvertently moving relative said capsule.

2. The assembly according to claim 1, wherein said first half and said second half of said capsule join together along a common seam.

3. The assembly according to claim 2, wherein said common seam bisects said access opening.

4. The assembly according to claim 1, wherein said first half and said second half of said capsule are joined by a hinge.

5. The assembly according to claim 1, wherein said capsule is spherical in shape.

6. The assembly according to claim 1, wherein said capsule has a smooth exterior surface capable of being adhered to by said suction cup.

7. The assembly according to claim 1, wherein said capsule is translucent so that said toy figure can be seen within said capsule through said capsule.

8. The assembly according to claim 1, wherein said toy figure is molded of elastomeric material.

9. A toy structure, comprising:

a plurality of capsules, each of said capsules having a first half and a second half that selectively join together by a snap fit interconnection;

a plurality of toy assemblies, wherein each of said toy assemblies includes a toy figure and at least one suction cup that extends from said toy figure, wherein each of said plurality of capsules receives one of said toy assemblies so that each said toy figure is positioned inside one of said capsules and each said suction cup is positioned external of one of said capsules;

wherein each of said plurality of capsules are interconnected into said toy structure by each said suction cup extending from said toy assemblies within said plurality of capsules.

10. The structure according to claim 9, wherein said first half and said second half of each of said plurality of capsules are joined together by a hinge.

11. The structure according to claim 10, wherein at least some of said plurality of capsules are interconnected by forming said snap fit interconnection between said first said half and said second half of different capsules from said plurality of capsules.

12. The structure according to claim 9, wherein a neck joins each said toy figure to each said suction cup.

13. The structure according to claim 12, wherein each of said plurality of capsules defines at least one access opening wherein each said access opening engages each said neck with a friction fit, therein positioning each said toy figure within each said capsule and preventing each said toy figure from inadvertently moving relative each said capsule.

14. The structure according to claim 13, wherein said first half and said second half of each of said capsules join together along a common seam.

15. The structure according to claim 14, wherein said common seam bisects said access opening on each of said capsules.

16. The structure according to claim 9, wherein at least some of said plurality of capsules are translucent so that each said toy figure can be seen within each of said capsules.

* * * * *